US007547067B2

(12) United States Patent
Keilhauer et al.

(10) Patent No.: US 7,547,067 B2
(45) Date of Patent: Jun. 16, 2009

(54) TILT AND SWIVEL CHAIR AND MECHANISM THEREFOR

(75) Inventors: Steve Keilhauer, Toronto (CA); Vlad Zila, Markham (CA); Martin Bergmann, Vienna (AT); Gernot Bohmann, Vienna (AT); Harald Grundl, Vienna (AT)

(73) Assignee: Keilhauer (Partnership), Toronto, Ontario (CA)

( * ) Notice: Subject to any disclaimer, the term of this patent is extended or adjusted under 35 U.S.C. 154(b) by 471 days.

(21) Appl. No.: 11/190,268

(22) Filed: Dec. 1, 2004

(65) Prior Publication Data

US 2006/0138840 A1 Jun. 29, 2006

(51) Int. Cl.
*A47C 1/00* (2006.01)

(52) U.S. Cl. ..... 297/313; 297/314

(58) Field of Classification Search ..... 297/313, 297/314, 302.1; 248/562, 565, 575, 578, 248/416; 267/169, 175, 177, 34, 131
See application file for complete search history.

(56) References Cited

U.S. PATENT DOCUMENTS

| | | | | | |
|---|---|---|---|---|---|
| 522,387 | A | | 7/1894 | Pederson | |
| 621,140 | A | | 3/1899 | Reuter | |
| 2,132,291 | A | | 2/1938 | Reuter | |
| 3,309,137 | A | | 3/1967 | Wiebe | |
| 4,099,697 | A | | 7/1978 | Von Schuckmann | |
| 4,181,281 | A | * | 1/1980 | Kosak | 248/416 |
| 4,372,606 | A | | 2/1983 | Faull | |
| 4,440,372 | A | * | 4/1984 | Wisniewski | 248/406.2 |
| 4,860,987 | A | * | 8/1989 | Werner | 248/405 |
| 4,871,208 | A | | 10/1989 | Hodgdon | |
| 4,872,635 | A | * | 10/1989 | Knoblock et al. | 248/406.2 |
| 4,932,719 | A | | 6/1990 | Gonzalez | |
| 4,974,904 | A | * | 12/1990 | Phillips et al. | 297/258.1 |
| 5,039,164 | A | * | 8/1991 | Gibbs | 297/302.1 |
| 5,044,587 | A | | 9/1991 | Degen | |
| 5,524,967 | A | | 6/1996 | Glockl | |
| 5,556,170 | A | | 9/1996 | Lai et al. | |
| 5,749,557 | A | * | 5/1998 | Chang | 248/405 |
| 5,909,925 | A | | 6/1999 | Glockl | |
| 5,921,628 | A | | 7/1999 | Glockl | |
| 6,003,944 | A | | 12/1999 | Glockl | |
| 6,106,084 | A | | 8/2000 | Thogersen et al. | |
| 6,116,584 | A | * | 9/2000 | Romer | 267/64.24 |
| 6,601,818 | B1 | * | 8/2003 | Larsen | 248/621 |
| 6,997,511 | B2 | * | 2/2006 | Marchand et al. | 297/314 |
| 2002/0043868 | A1 | | 4/2002 | Glockl | |

FOREIGN PATENT DOCUMENTS

| | | |
|---|---|---|
| AU | 718 284 | 8/1997 |
| CA | 2 244 813 | 8/1997 |

(Continued)

OTHER PUBLICATIONS

Swopper brochure, undated (German).

*Primary Examiner*—David Dunn
*Assistant Examiner*—Erika Garrett
(74) *Attorney, Agent, or Firm*—Patterson & Sheridan, L.L.P.

(57) ABSTRACT

The invention provides a chair and mechanism to permit occupant swivelling, bouncing, and tilting. The chair mechanism also provides tilt limitation using a keyhole tilt delimiter. The keyhole orientation follows rotation of the chair. A bearing assembly (preferably using race bearings) facilitates simultaneous swivelling and tilting.

25 Claims, 10 Drawing Sheets

FOREIGN PATENT DOCUMENTS

| | | | |
|---|---|---|---|
| DE | 921 588 | | 11/1954 |
| DE | 178 342 | | 4/1959 |
| DE | 182 791 | | 4/1961 |
| DE | 1 205 666 | | 11/1965 |
| DE | 1 981 518 | | 3/1968 |
| DE | 2 642 112 | | 3/1978 |
| DE | 7 531 129 | | 3/1978 |
| DE | 2 843 175 | | 4/1980 |
| DE | 8 206 113 | | 8/1982 |
| DE | 3 207 941 | A1 | 9/1983 |
| DE | 4 210 098 | A1 | 9/1993 |
| DE | 4 210 099 | A1 | 9/1993 |
| DE | 195 04 121 | A1 | 8/1996 |
| EP | 0 808 116 | B1 | 11/1997 |
| FR | 1 480 037 | | 5/1967 |
| WO | WO 93/19645 | | 10/1993 |
| WO | WO 96/24273 | | 8/1996 |
| WO | WO 97/27785 | | 8/1997 |

* cited by examiner

TILT AND SWIVEL CHAIR AND MECHANISM THEREFOR

BACKGROUND OF THE INVENTION

1. Field of the Invention

The invention relates to chairs, and more particularly, to chairs capable of tilting and swivelling.

2. Description of the Related Art

An occupant of a chair, such as an office chair, does not remain stationary throughout the course of the day. The occupant is frequently required to change position, whether to move the occupant's spatial position on the floor, or to rotate to face sideward or rearward, or to reach for an object positioned away from the occupant.

To an extent, modern desk chairs address these mobility concerns by providing caster wheels on the base (allowing spatial positioning) and by providing a swivel means immediately below the seat part of the chair (allowing the occupant to face in different directions). However, chair designers have had difficulty addressing the reach concern without compromising the comfort or safety of the occupant.

The ability to move in place while seated is also an ergonomic issue. Certain recent seating improvements have allowed the occupant to tilt in various directions. This moderate degree of mobility is considered important to improve circulation and accommodate the natural "restlessness" of the body, even while seated. Even in stationary chairs, occupants tend to shift their body weight, by leaning from side-to-side and back-and-forth. Stress on the spine and ischia and reduced blood flow to the legs can result if such natural shifting movement is not accommodated in the chair.

While many chairs provide rearward tilting of the seat pan or seat back (or both) to allow the occupant to partially recline, tilting the entire chair at the base more closely mimics the natural shifting movements of the body, using the ankles as a pivot point. The base tilt also allows the occupant's feet to stabilize the chair. However, there is a concern that, in rearward or, especially, in rear-sideward tilting, the occupant may lose control, tilting back (and to the side) too far for the occupant to correct, which may result in the occupant either tipping the chair or falling off the seat, which may lead to injury. It would be beneficial to allow base tilting of the chair in circumscribed degrees to reduce the likelihood of rear-sideward spills.

Such tilting should be accommodated as an additional feature in harmony with other normal functions of a chair, such as swivelling and spring-based "bouncing".

SUMMARY OF THE INVENTION

According to a first aspect of the invention, a chair is provided comprising a seat, a base and an elongate structure. Preferably, the base has legs that extend to the floor. The base defines a longitudinal axis. Preferably, the elongate structure is connected to the seat at a first end, and to the base, and extends through the base to terminate at a second end. The elongate structure comprises a pillar assembly, an outer cover housing a portion of the pillar assembly, a tilt ring, and a base portion. The pillar assembly is connected to the seat at the first end. The tilt ring preferably engages in part a lower portion of the outer cover. The base portion is preferably connected to the tilt ring and base. The base portion preferably comprises a bearing assembly.

The chair allows tilting and swivelling movements. To permit tilting, the pillar assembly and outer cover are preferably tiltable in any direction against the tilt ring to tilt the seat.

When tilting force is applied to the seat, the seat is moved from an axial orientation with respect to the longitudinal axis of the base. When such tilting force is relieved, the tilt ring returns the pillar assembly and outer cover to axial orientation. To permit swivelling or rotating the seat, the pillar assembly, the outer cover, and the tilt ring are preferably swivellable at the bearing assembly.

Preferably, the base portion comprises a keyhole delimiter that defines a keyhole. The bottom end of the pillar assembly engages the keyhole, which limits the degrees of tilt permitted. The keyhole may be shaped:

to permit a greater rearward tilt range than frontward tilt range;

to permit a greater sideward tilt range than rear-sideward tilt range;

to permit less rear-sideward tilting than any other direction;

to encourage rear-sideward tilting toward rearward tilting;

substantially symmetrically from side-to-side and substantially asymmetrically from back-to-front (meaning that the sides of the keyhole are approximately equidistant from dead-center, whereas the back and front are different distances from dead-center).

Preferably, the chair further comprises a clocking system. The clocking system allows the swivelling parts, namely the pillar assembly, the outer cover, the tilt ring and the tilt delimiter, to swivel together. This allows the orientation of the keyhole to be maintained in the course of rotating the seat.

The bearing assembly preferably comprises at least one race bearing, preferably a pair of race bearings. The first race bearing is preferably positioned in an upper portion of the base portion, while the second race bearing is preferably positioned in a lower portion of the base portion. The bearing assembly assists the swivelling of the chair. Preferably, the chair is capable of swivelling in tilted and untilted modes.

For tilting, the tilt ring preferably comprises a flexible ring capable of elastic displacement when tilting force is applied.

The chair may also have "spring" or "bounce" movement. The pillar assembly may further comprise a spring system to allow the springing or bouncing movement of the seat. The spring system preferably has starting and ending positions along a second longitudinal axis defined by the pillar assembly and the outer cover of the structure. Preferably, the spring "system" comprises two elements: a cylinder and a spring. The cylinder may be a pneumatic cylinder. The spring may be a coil spring, such as a variable rate coil spring. The spring system is preferably integrated with the pillar assembly, which may be understood as a "spring pillar assembly".

As optional features of the chair, the seat may include a back, and the base may include wheels on the legs.

The foregoing are examples of certain aspects of the present invention. Many other embodiments are also possible and will become apparent to those skilled in the art from a review of the detailed description of certain preferred embodiments of the present invention.

3A: First stage assembly

3B: Second stage assembly

3C: Third stage assembly

3D: Fourth stage assembly

3E: Fifth stage assembly

3F: Sixth stage assembly (completed)

Figure 4:
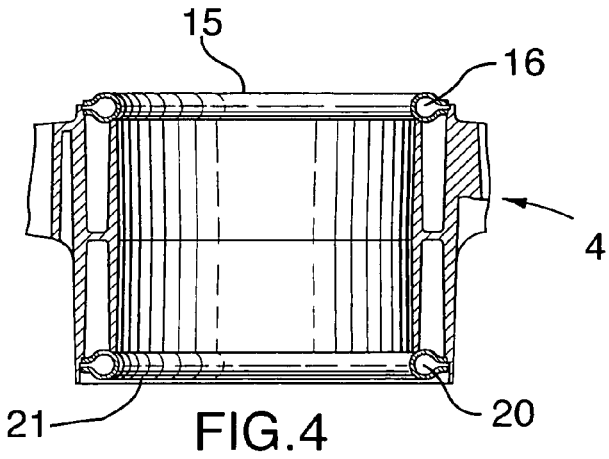

FIG. 4 shows a detailed view of the base 4 and bearing components (in section).

Figure 5:
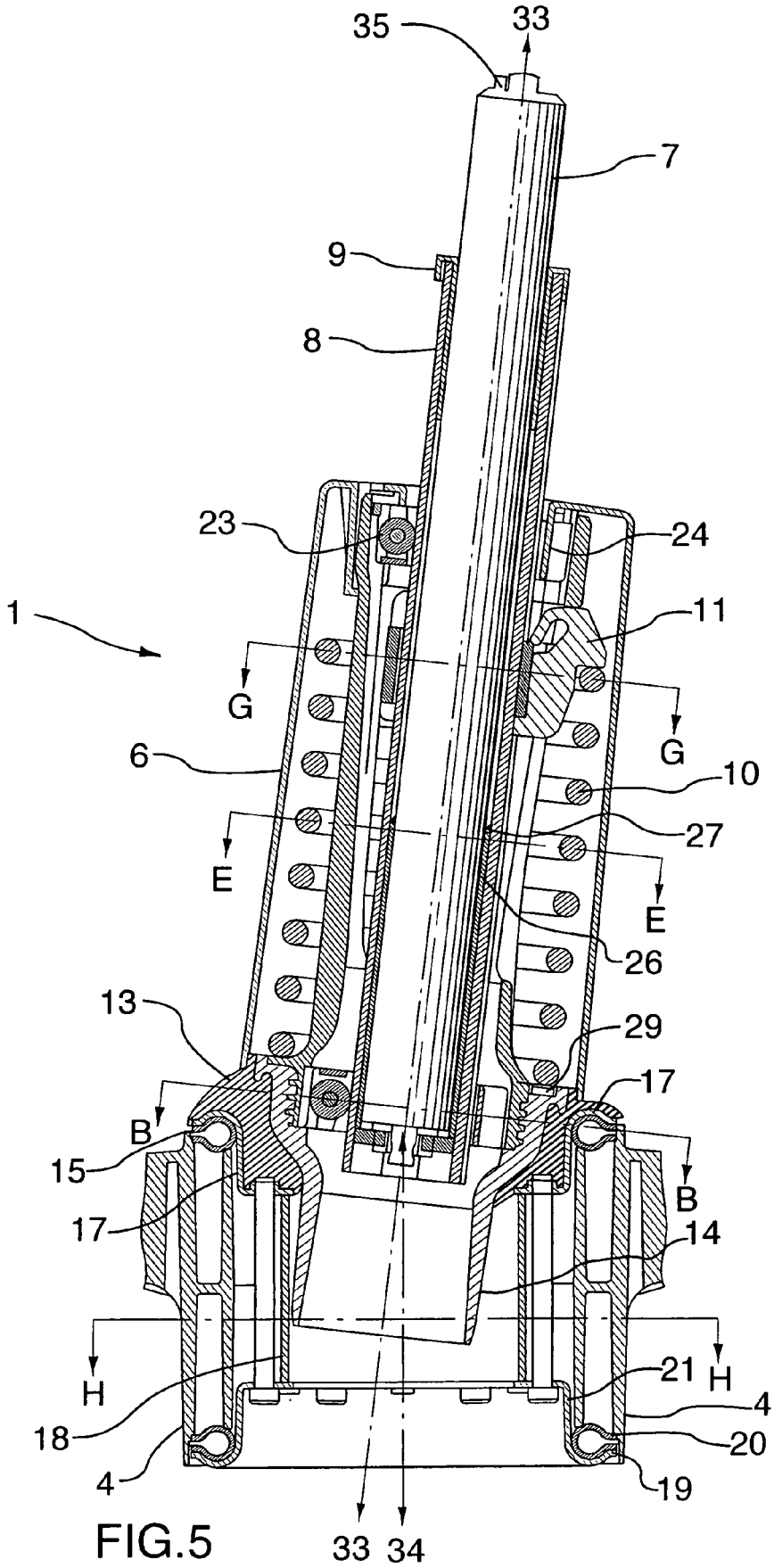

FIG. 5 shows a sectional view of the mechanism 1 in tilt orientation.

Figure 6A:
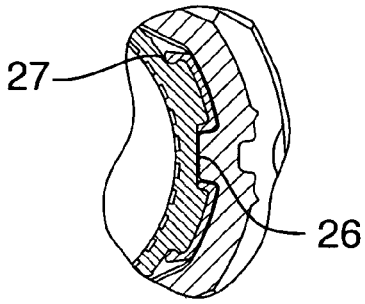
Figure 7A:
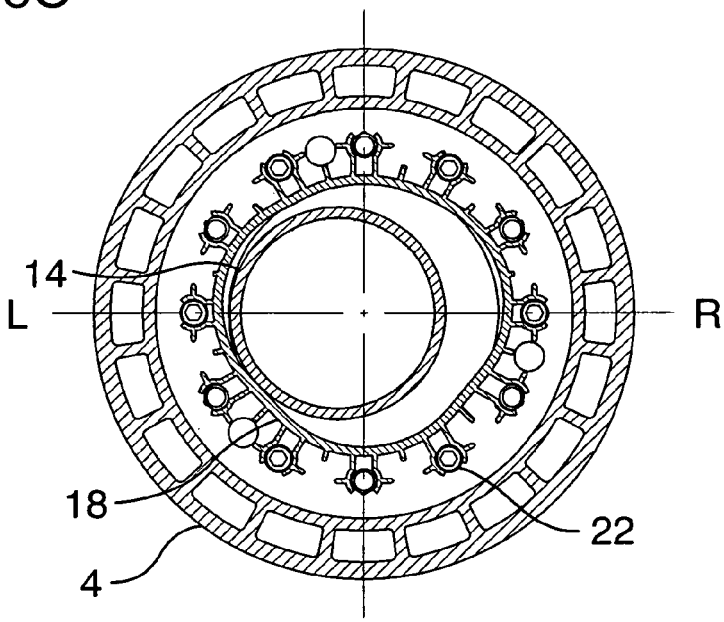
Figure 7B:
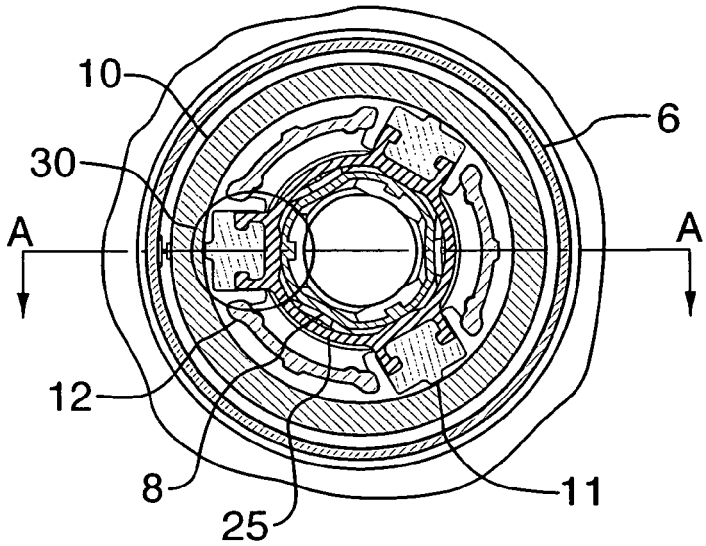
Figure 7C:
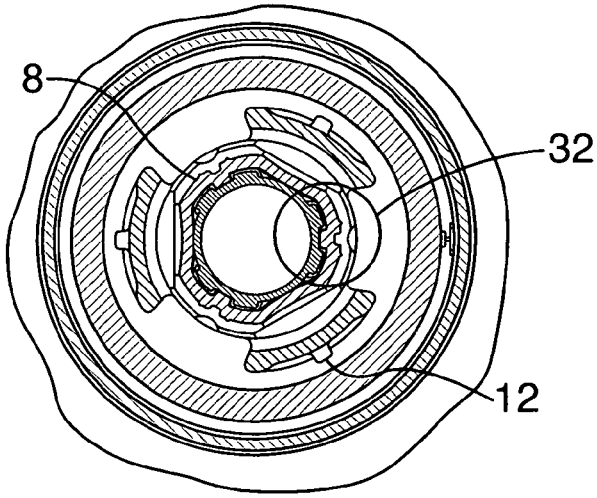

FIG. 6A shows a detailed view of area 32 of the cross-section shown in FIG. 7C.

Figure 6B:
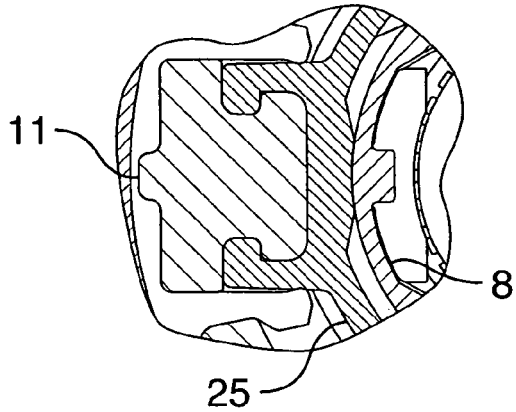

FIG. 6B shows a detailed view of area 30 of the cross-section shown in FIG. 7B.

Figure 6C:
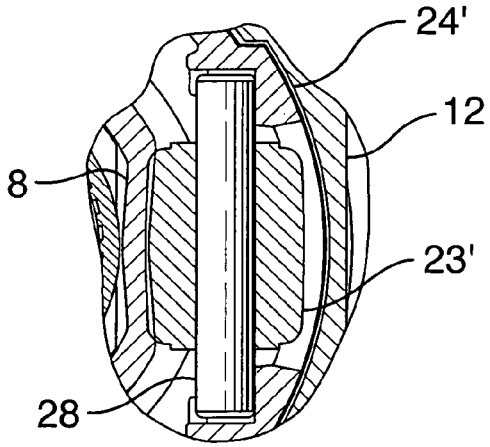
Figure 7D:
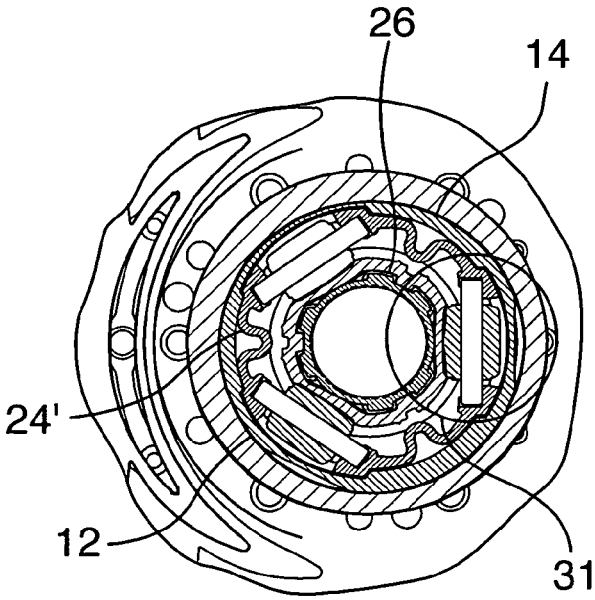

FIG. 6C shows a detailed view of area 31 of the cross-section shown in FIG. 7D.

FIG. 7A shows a cross-section through line H-H of FIG. 5, showing keyhole ring 18.

FIG. 7B shows a cross-section through line G-G of FIG. 5, showing coil spring 10 and spring locator 11.

FIG. 7C shows a cross-section through line E-E of FIG. 5, showing central post 12 features.

FIG. 7D shows a cross-section through line B-B of FIG. 5, showing roller 23' and roller holder 24'.

Figure 8A:
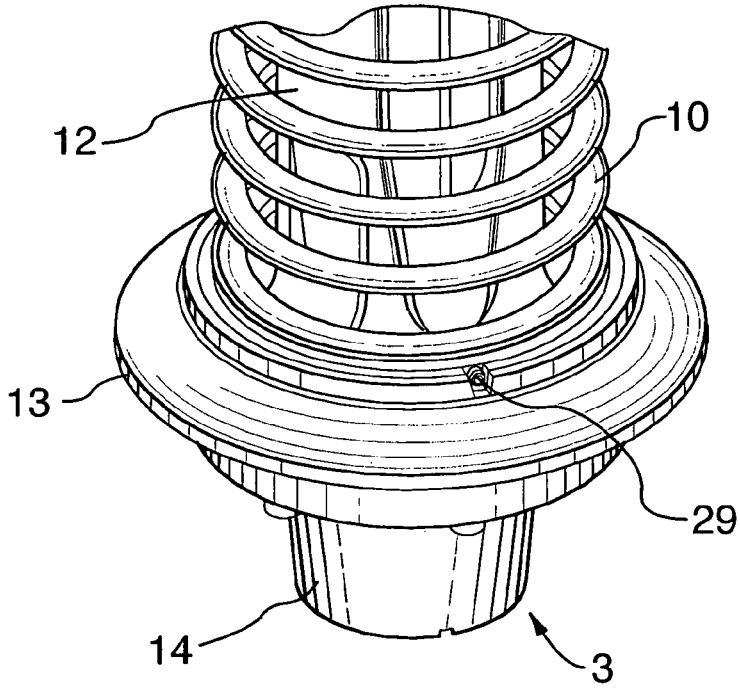

FIG. 8A shows a front perspective view of the coil spring 10 and base 4 components.

Figure 8B:
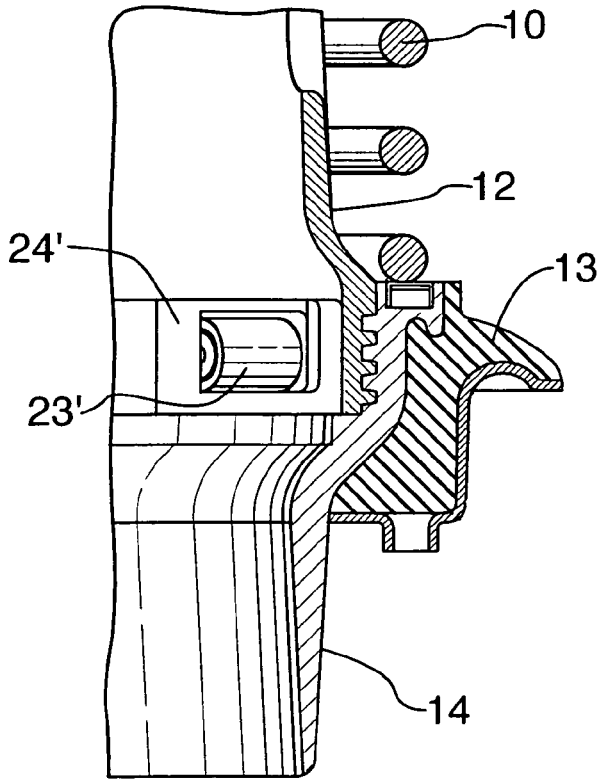

FIG. 8B shows a sectional view of the coil spring 10 and base 4 components in FIG. 8, also showing roller 23'.

DETAILED DESCRIPTION

Figure 1:
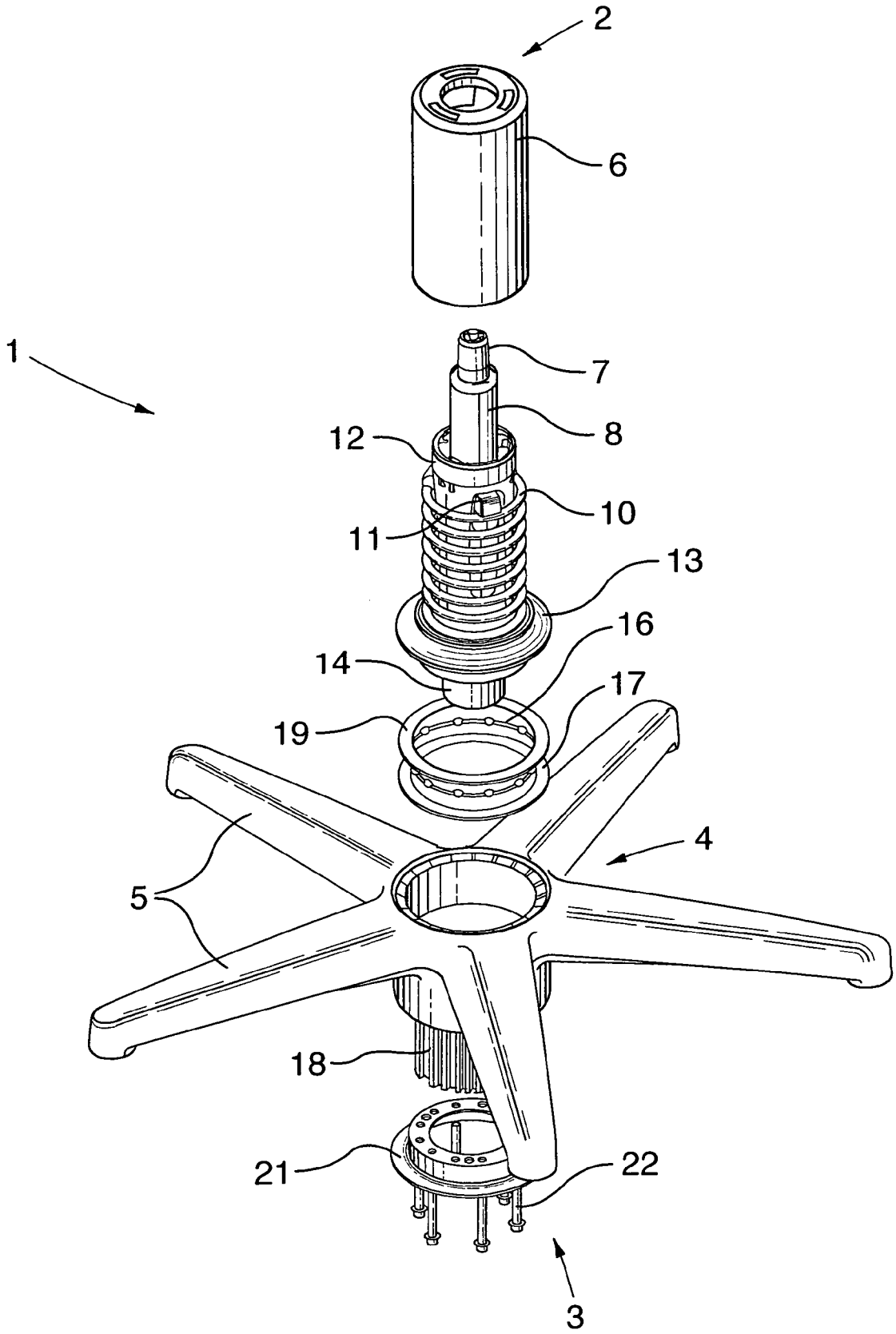
FIG. 1 shows an exploded view of the mechanism, according to the preferred embodiment.
Figure 1A:
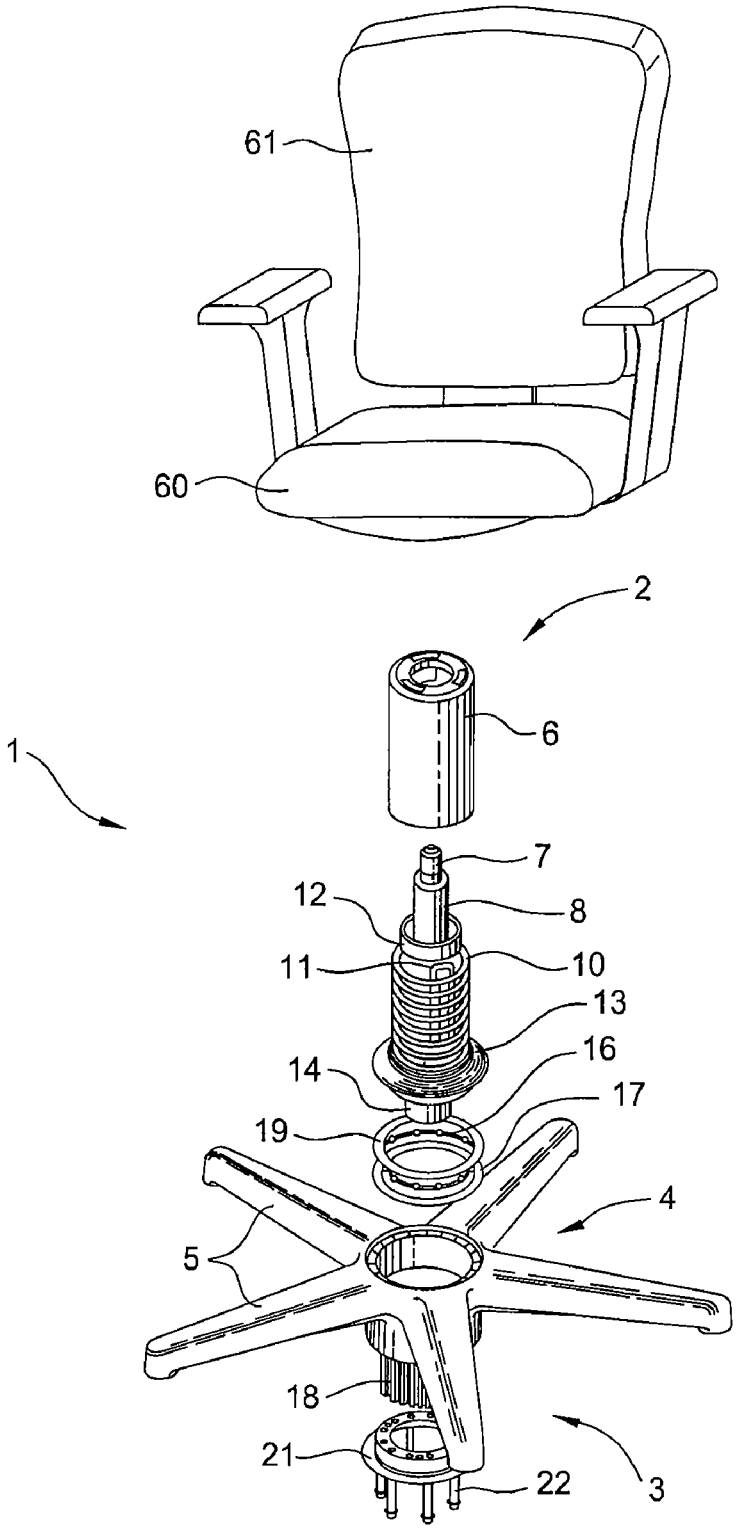
Figure 2:
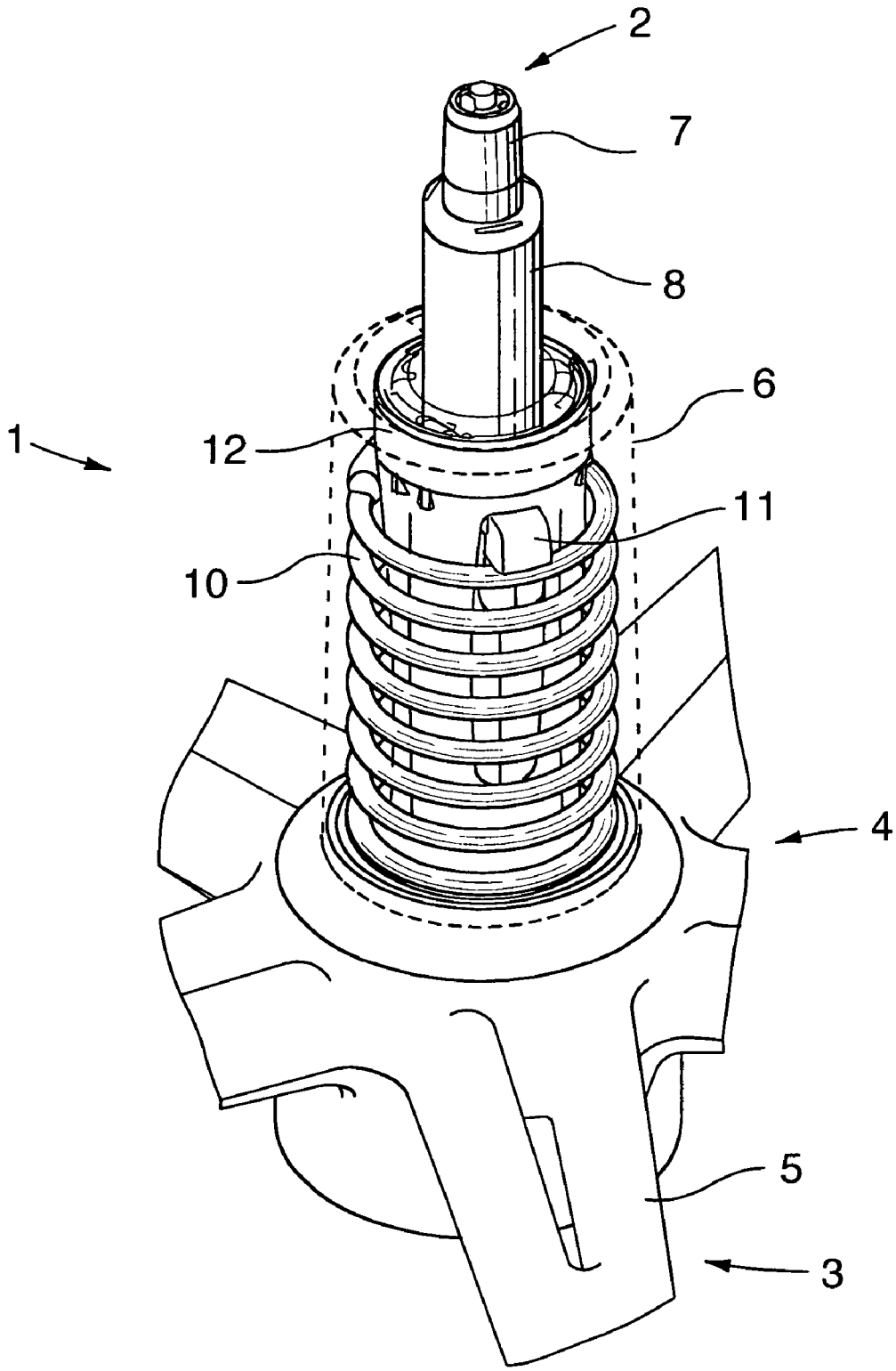
FIG. 2 shows an assembled view of the mechanism in FIG. 1, with outer cover 6 shown, but with legs 5 truncated.

The invention provides a tilting and swiveling chair. The mechanism 1 is intended for use in a chair, especially a chair of the type commonly used in offices (having a seat 60 and a seat back 61 the seat 60 being positioned over a column, the column terminating in a branched base with legs). The mechanism 1 is preferably an elongate structure, which takes the place of the seat column. As shown in FIGS. 1, 1A, and 2, the elongate structure has two ends 2, 3. The first end 2 is connected to the seat 60, preferably by means of a tapered fit, and the second end 3 extends through the base 4 to terminate slightly above the floor. Advantageously, the legs 5 may include wheels, such as conventional office chair casters (not shown).

The mechanism 1 allows three basic occupant motions:

swiveling;

bouncing (i.e. longitudinal travel); and tilting.

The mechanism 1 is adapted to perform all of the above motions. In addition, the mechanism comprises means for limiting the amount of tilt permitted (independent of swivel). The functional aspects of the mechanism 1 are now described.

Swivel Motion

The mechanism 1 allows swivelling with respect to the base 4. A bearing ring (such as a race bearing) is provided to facilitate the swivelling by reducing friction between swivelling and non-swivelling parts of the mechanism 1. Preferably, as shown in FIG. 4, a pair of bearing rings 16, 20 is provided, one each at upper and lower ends of the base 4.

The mechanism 1 swivels at the bearing rings 16, 20 while the base 4 remains stationary. The mechanism 1 is preferably capable of swivelling in tilted (as shown in FIG. 5) or untilted state (as shown in FIG. 2). The bearing rings 16, 20 reduce friction to facilitate smooth rotation of the mechanism about the axis 34 defined by the base 4.

The mechanism 1 is preferably constructed so that the swivelling parts turn together (at the same rate of rotation and to the same degree). Rotation is transferred between adjacent parts by means of clocking and locating features. As shown in FIGS. 5, 6A and 7D, a clocking bushing 26 is preferably provided between the pneumatic cylinder 7 and the cylinder extruded tube 8. The bushing 26 preferably has a tab-in-groove fit with the cylinder extruded tube 8. The bushing 26 has the function of transferring swivel motion to the bearing rings 16, 20.

The outer cover 6 preferably rotates with its interior parts, as shown in FIG. 5. The cylinder extruded tube 8 threads to a predetermined stop to align the parts to a rubber tilt ring 13. Furthermore, the tilt ring 13, bottom post 14 and bearing cup 17 align with the keyhole delimiter ring 18. As shown in FIG. 5, pneumatic cylinder 7 contains a locating feature 35 to align the seat (not shown) attached at the first end 2.

Bounce Motion

In addition to swivel motion, the mechanism 1 preferably allows "bounce" motion along the longitudinal axis 33 defined by the tilting parts of the mechanism 1. Preferably, two parts supply the bounce action: the cylinder extruded tube 8 and the coil spring 10. The bounce moves the seat up and down to provide increased comfort and support and aid spinal alignment. The longitudinal axis 33 moves in unison with the axis of the occupant's spine (i.e. the occupant's center of gravity moves with the chair). This has the effect of reducing gravitational pressure on the occupant's spine.

The cylinder extruded tube 8 preferably moves up and down within the central post 12, assisted by upper and lower rollers 23, 23'.

As shown in FIG. 5, the coil spring 10 is preferably acted upon by a spring locator 11. The coil spring 10 may be a variable rate coil spring that compresses variably with the occupant's weight (i.e. compression becomes progressively more difficult as load is applied).

In operation, the pneumatic cylinder 7, the cylinder extruded tube 8 and the coil spring 10 are activated in series when weight (load) is applied to the seat part (not shown). Downward pressure on the pneumatic cylinder 7 and the cylinder extruded tube 8 causes the spring locator 11 (which is attached to the extruded tube 8 via flange 25, shown in detail in FIG. 6B) to compress the coil spring 10. Both the cylinder extruded tube 8 and the coil spring 10 act to return the chair seat to preset "normal" height when the seat is not under load. The outer cover 6, the base 4 and the tilt ring 13 are not affected by the bounce.

The height of the seat can also be adjusted by extending or compressing the pneumatic cylinder 7 inside the tube 8. The height of the seat, set by the pneumatic adjustment, does not affect the bounce range of the cylinder extruded tube 8, which operates independently. A preferred range of bounce travel is approximately 3 inches. Means may optionally be provided to adjust the bounce resistance or to permit a + or − range of travel (not shown).

Tilting

As shown in FIG. 5, the mechanism 1 (in loaded or unloaded state) allows tilting. At rest, the axis 33 of the tilting parts of the mechanism 1 is substantially co-linear with the axis 34 of the base 4. When tilt pressure is applied from the seat, certain parts of the mechanism tilt while the base 4 remains stationary. The cylinder 7, the tube 8, the coil spring 10, the outer cover 6, the central post 12, and bottom post 14 all tilt together with their internal parts. The lower shoulders of the outer cover 6 (housing the central post 12, cylinder 7, tube 8, and coil spring 10) and the attached bottom post 14 bear upon a flexible tilt ring 13. The flexible ring 13 and bearing cup 17 remain stationary with the base 4; however the flexible material of the ring 13 elastically displaces to accommodate the tilting parts.

The flexible tilt ring 13 has several functions. It cushions and supports the outer cover 6 and bottom post 14 when tilted. The ring 13 provides resistance against tilting, and resistance will increase depending on load. The ring 13 may be made of rubber or synthetic rubber, or similar elastic material, such as silicone. The skilled person will appreciate that the shore hardness of the flexible material used in the ring can be adjusted to modify the resistance. The ring 13 also gently restores the tilting parts of the mechanism 1 back into vertical alignment with the base 4 when the tilt pressure is removed. The ring 13 flexibly bonds the bottom post 14 to the bearing cup 17.

Tilt Delimiter

To control the degree of tilting, a keyhole delimiter ring 18 is preferably provided in the base 4 of the mechanism 1. As shown in FIG. 7A, the shape of the interior of the keyhole ring 18 is preferably slightly eccentric. The aperture of the keyhole delimiter ring 18 preferably has a broader "Back" portion and a narrower "Front" portion. ("Front" and "Back" refer to the occupant's facing direction. Note, however, that the "Back" portion of the aperture governs the occupant's forward tilt motions, while the narrower "Front" portion of the aperture governs the occupant's backward tilt motions.) Sloped edges are preferably provided between the front and back portions. The keyhole ring 18 circumscribes where the bottom post 14 (connected with the other tilting parts of the mechanism) may tilt. Front and front-sideward tilt movements are least restricted (to allow reaching motions). Rearward motions are permitted, but rear-sideward motions are nudged into rearward direction to permit relaxation tilt postures, while preventing rear-sideward spills. Preferably, the keyhole delimiter ring permits approximately 7° forward tilt, 10° backward tilt, 7° sideward tilt, and 5° rear-sideward tilt.

The keyhole delimiter ring 18 preferably moves with the swivelling of the chair, so that the frontward orientation is maintained relative to the occupant in the seat. The function of the keyhole delimiter ring 18 is not affected by downward motion of the cylinder extruded tube 8 and coil spring 10.

Construction and Materials

Looking at FIGS. 1-4, the preferred construction of the mechanism 1 will now be described. In particular, FIGS. 3A-3F illustrate the assembly of the mechanism, step by step.

Figure 3A:
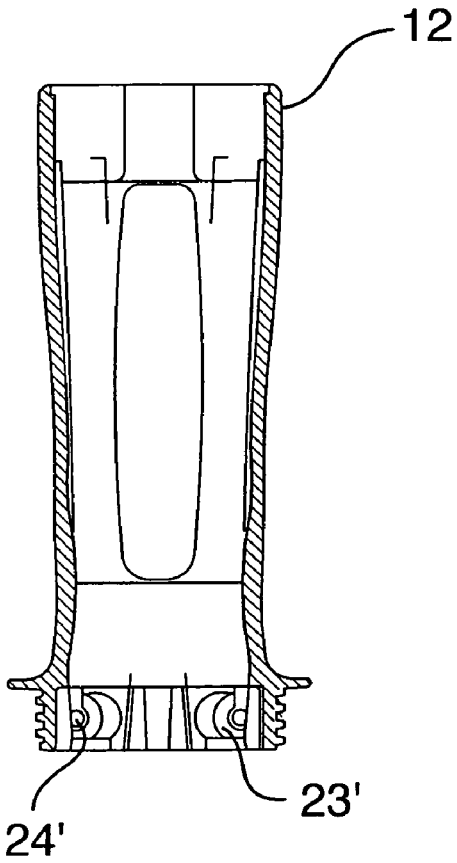
FIGS. 3A-3F show assembly diagrams of the mechanism (in section) in the preferred order of assembly.
Figure 3B:
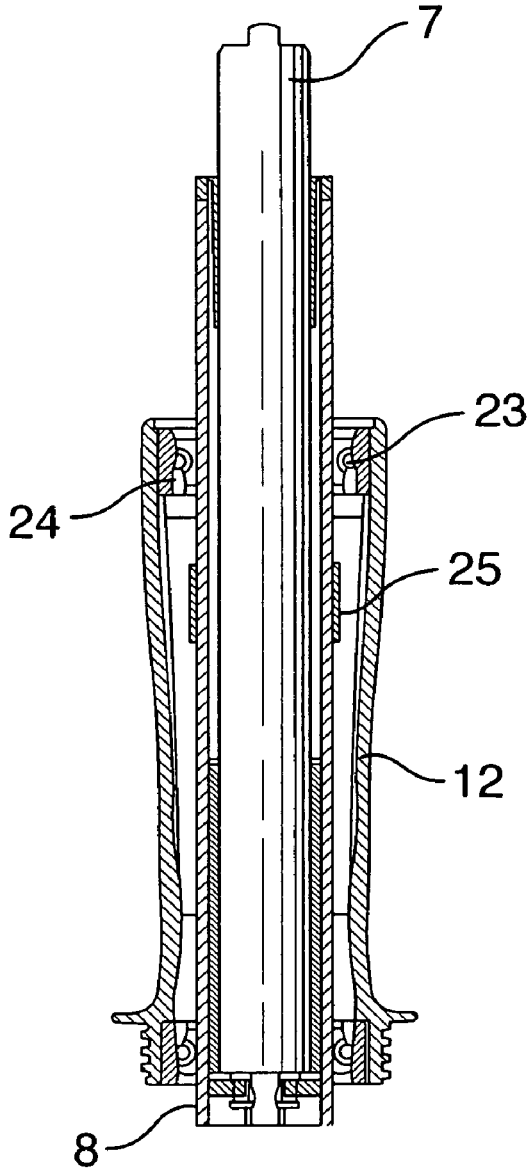
Figure 3C:
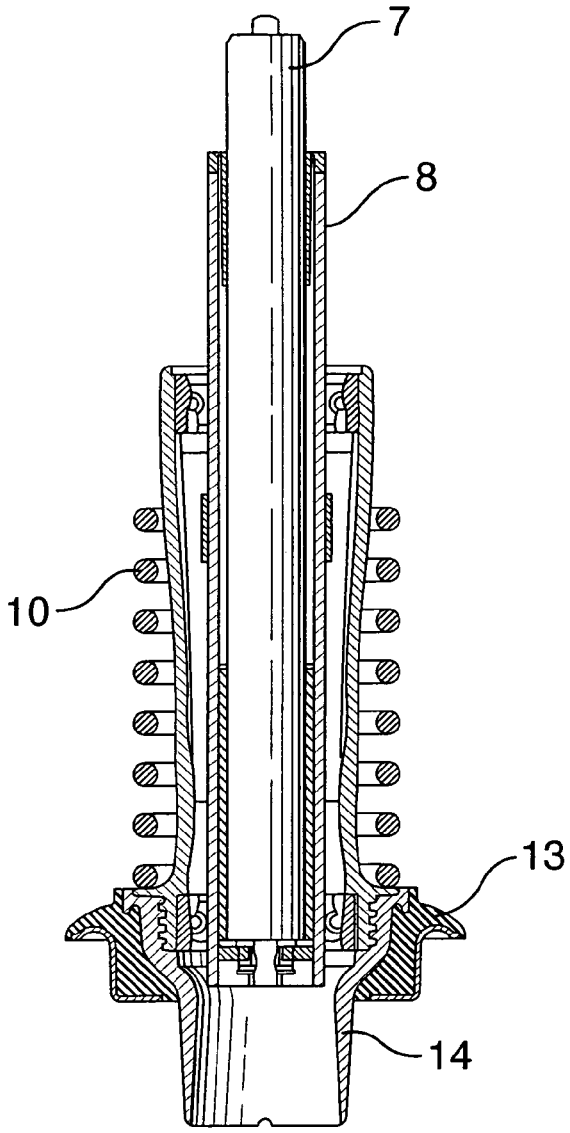

Beginning at FIG. 3A, the central post 12 is provided, which consists of the main internal support member for the mechanism 1. The central post 12 is a hollow, tapered body having a wide top section tapering to a narrower mid-section, broadening again at the bottom. The bottom section is preferably provided with a threaded exterior portion adapted for threaded connection to the bottom post 14, as shown in FIGS. 3C and 8B. The central post is preferably constructed of cast aluminum.

As shown in FIGS. 3A and 8B, the central post 12 houses the lower rollers 23' in roller holders 24'. There are preferably 3 rollers arranged as shown in FIG. 7D. Upper rollers 23 in roller holders 24 are also housed in the central post 12, as shown in FIG. 3B. The upper and lower rollers 23, 23' are preferably constructed of a roller tube positioned over a dowel pin 28 as shown in FIG. 6C.

As shown in FIG. 5, the clocking bushing liner 27 is snapped on to the clocking bushing 26 on the pneumatic cylinder 7. This assembly is next installed in the cylinder extruded tube 8 (sandwiching upper bushing 9, which is used to guide the cylinder 7 and reduce friction). The flange 25 is slid on the tube 8 and rotated 180° to lock the flange 25 in place. The tube 8 is positioned within the cavity defined in the central post 12 and supported within rollers 23. The cylinder 7 and tube 8 extend from the top of the mechanism 1 to a point within the base 4. The spring locators 11 are attached to flange 25.

Figure 3D:
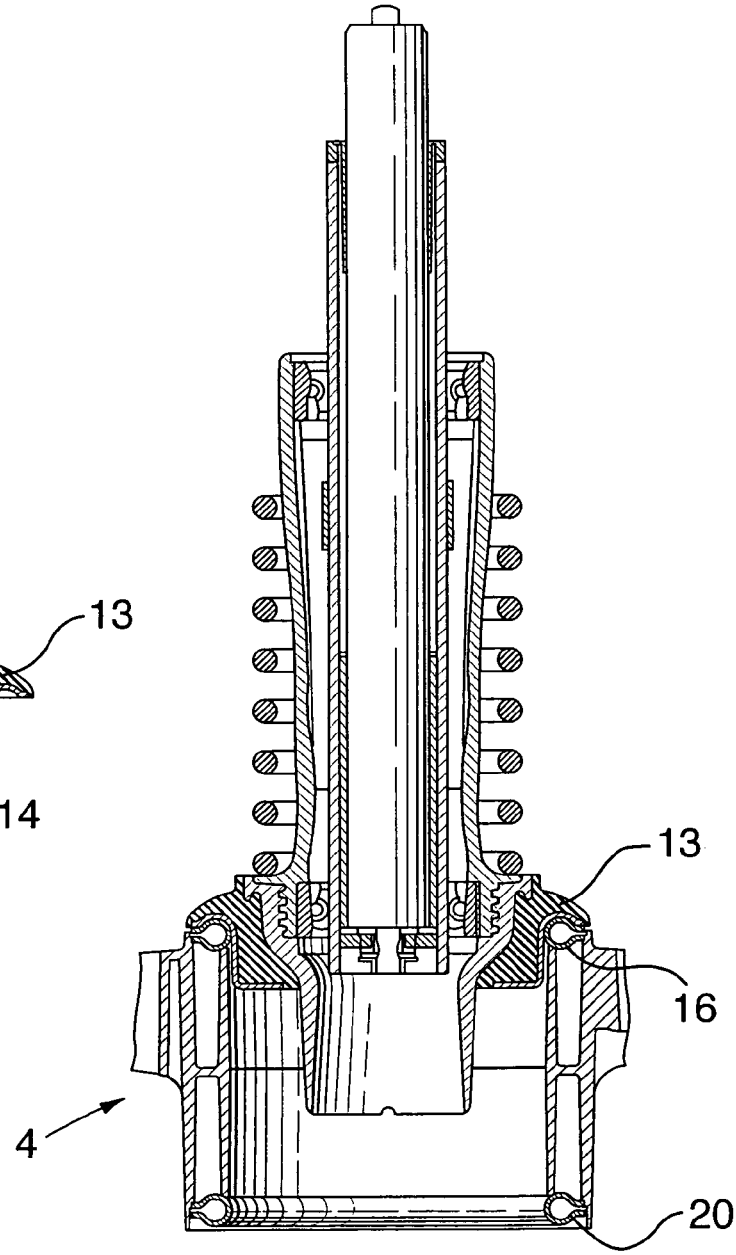
Figure 3E:
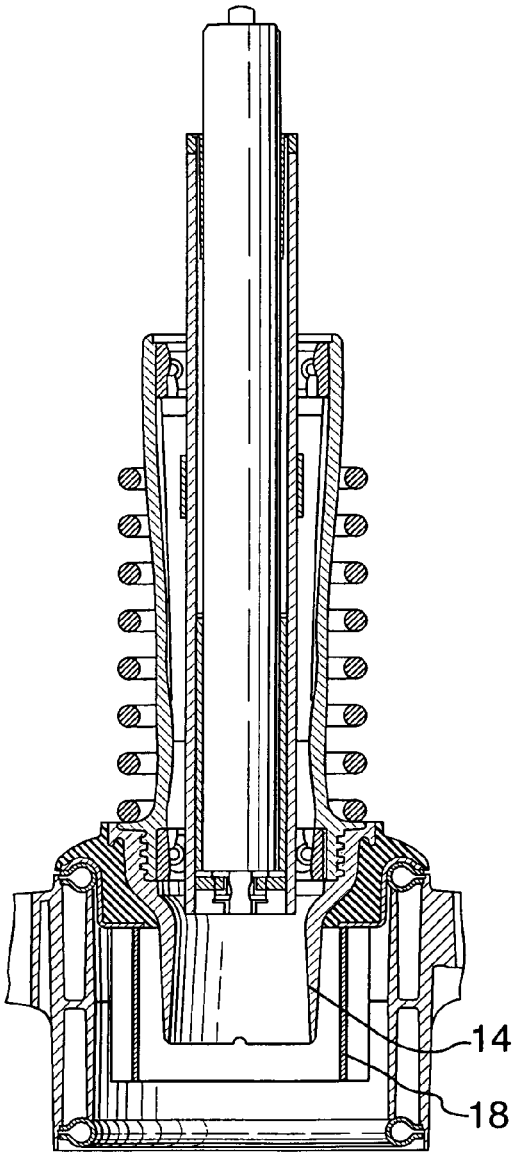

As shown in FIG. 3C, the central post 12 is threadably connected to a permanently-bonded assembly consisting of the flexible tilt ring 13 and bottom post 14 and bearing cup 17. As shown in FIG. 8A, a set screw 29 is screwed to the central post 12 to prevent unthreading of the threaded parts. As shown in FIG. 3D, the coil spring 10 sits atop the top part of the bottom post 14.

As shown in FIG. 5, the bearing cups 17, 21 sandwich the keyhole delimiter ring 18. The bearings 16, 20 are preloaded due to the height of the keyhole delimiter 18. This sandwich has the effect of reducing the side-to-side "play", while maintaining the ability to swivel independently of the base 4.

The keyhole ring 18 is preferably constructed of aluminum. The sandwich is preferably held together using socket head cap screws 22 (also shown in FIGS. 1 and 5).

Figure 3F:
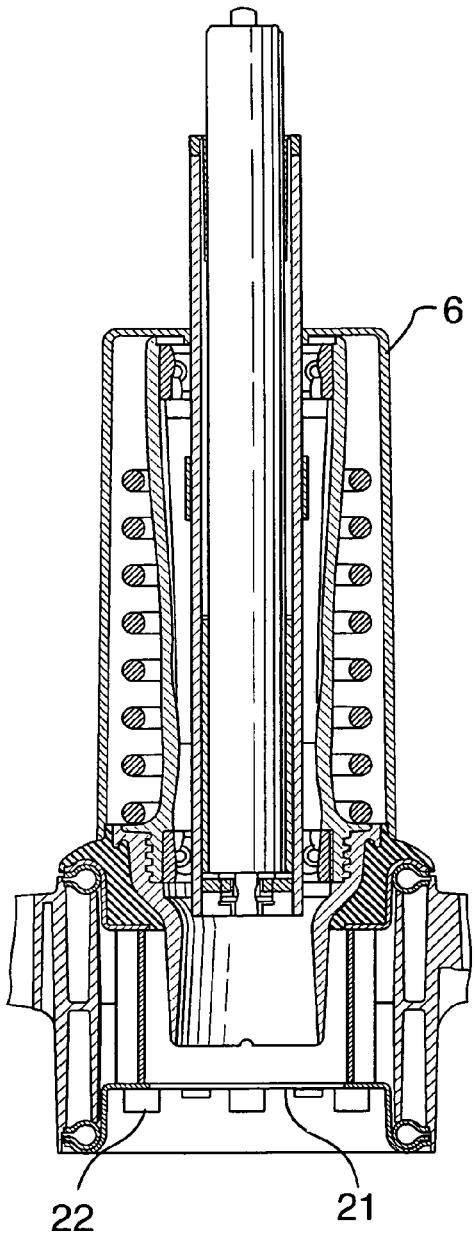

An outer cover 6 caps the coil spring 10 and central post 12, as shown in FIG. 3F. The outer cover 6 is preferably of translucent polypropylene, to allow the coil spring to be visible by the occupant. The cover 6 is preferably attached using molded snap clips.

The base 4 preferably includes branched legs 5 as shown in FIG. 1. Wheels may be provided (not shown).

The foregoing description illustrates only certain preferred embodiments of the invention. The invention is not limited to the foregoing examples. That is, persons skilled in the art will appreciate and understand that modifications and variations are, or will be, possible to utilize and carry out the teachings of the invention described herein. Accordingly, all suitable modifications, variations and equivalents may be resorted to, and such modifications, variations and equivalents are intended to fall within the scope of the invention as described and within the scope of the claims.

The invention claimed is:

1. A chair comprising:

a seat;

a base having legs that extend to the floor;

an elongate structure connected to the seat at a first end and to the base at a second end, the base defining a longitudinal axis, and the elongated structure comprising:

a pillar assembly connected to the seat at the first end;

an outer cover housing a portion of the pillar assembly;

a tilt ring engaging in part a lower portion of the outer cover;

a base portion connected to the tilt ring and the base; the base portion comprising a bearing assembly and a keyhole delimiter, the keyhole delimiter defining a keyhole that is engaged by a bottom end of the pillar assembly to limit the degrees of tilt permitted;

the pillar assembly and the outer cover being tiltable in any direction against the tilt ring to tilt the seat away from an axial orientation with respect to the longitudinal axis of the base when tilting force is applied from the seat, the tilt ring returning the pillar assembly and outer cover to the axial orientation when such tilting force is relieved; and the pillar assembly, the outer cover, and the tilt ring being capable of swiveling at the bearing assembly to rotate the seat about the longitudinal axis.

2. The chair of claim 1, wherein the keyhole is shaped to permit a greater rearward tilt range than frontward tilt range.

3. The chair of claim 1, wherein the keyhole is shaped to permit a greater sideward tilt range than rear-sideward tilt range.

4. The chair of claim 1, wherein the keyhole is shaped to permit less rear-sideward tilting than any other direction.

5. The chair of claim 1, wherein the keyhole is shaped to encourage rear-sideward tilting toward rearward tilting.

6. The chair of claim 1, wherein the keyhole is substantially symmetrical from side-to-side and substantially asymmetrical from back-to-front.

7. The chair of claim 1, wherein the chair further comprises a clocking system for swivelling the pillar assembly, the outer cover, the tilt ring and the tilt delimiter together, such that the orientation of the keyhole is maintained in the course of rotating the seat.

8. The chair of claim 1, wherein the bearing assembly comprises a race bearing.

9. The chair of claim 8, wherein the bearing assembly comprises a pair of race bearings, a first race bearing being positioned in an upper portion of the base portion, and a second race bearing being positioned in a lower portion of the base portion.

10. The chair of claim 1, wherein the chair is capable of swivelling in tilted and untilted modes.

11. The chair of claim 1, wherein the tilt ring comprises a flexible ring, the tilt ring being capable of elastic displacement when tilting force is applied.

12. The chair of claim 1, wherein the pillar assembly further comprises a spring system movable between a starting and ending positions along a second longitudinal axis defined by the pillar assembly and the outer cover of the structure to move the seat.

13. The chair of claim 12, wherein the spring system comprises a cylinder and a spring.

14. The chair of claim 13, wherein the cylinder comprises a pneumatic cylinder.

15. The chair of claim 13, wherein the spring comprises a coil spring.

16. The chair of claim 15, wherein the coil spring comprises a variable rate coil spring.

17. The chair of claim 1, wherein the seat includes a back.

18. The chair of claim 1, wherein the base further comprises wheels on the legs.

19. A chair comprising:

a seat;

a base having legs that extend to the floor;

an elongate structure connected to the seat at a first end and to the base at a second end, the base defining a longitudinal axis, and the elongated structure comprising:

a pillar assembly connected to the seat at the first end;

an outer cover housing a portion of the pillar assembly;

a tilt ring engaging in part a lower portion of the outer cover;

a base portion connected to the tilt ring and the base; the base portion comprising a bearing assembly and a keyhole delimiter defining a keyhole;

the pillar assembly and the outer cover being tiltable in any direction against the tilt ring to tilt the seat away from an axial orientation with respect to the longitudinal axis of the base when tilting force is applied from the seat, the tilt ring returning the pillar assembly and outer cover to the axial orientation when such tilting force is relieved;

the pillar assembly, the outer cover, and the tilt ring being capable of swivelling at the bearing assembly to rotate the seat about the longitudinal axis; and a bottom end of the pillar assembly engaging the keyhole so as to limit the degrees of tilt permitted by the pillar assembly and the outer cover.

20. The chair of claim 19, wherein the tilt ring comprises a flexible ring, the tilt ring being capable of elastic displacement when tilting force is applied.

21. A chair comprising:

a seat;

a base having legs that extend to the floor;

an elongate structure connected to the seat at a first end and to the base at a second end, the structure defining a longitudinal axis, and the elongated structure comprising:

a spring pillar assembly connected to the seat at the first end;

an outer cover housing a portion of the pillar assembly;

a tilt ring engaging in part a lower portion of the outer cover;

a base portion connected to the tilt ring and the base; the base portion comprising a bearing assembly and a keyhole delimiter, the keyhole delimiter defining a keyhole that is engaged by a bottom end of the spring pillar assembly to limit the degrees of tilt permitted;

the spring pillar assembly being movable between starting and ending positions along a second longitudinal axis defined by the spring pillar assembly and the outer cover of the structure to move the seat;

the spring pillar assembly and the outer cover being tiltable in any direction against the tilt ring to tilt the seat away from an axial orientation with respect to the longitudinal axis when tilting force is applied from the seat, the tilt ring returning the spring pillar assembly and outer cover to the axial orientation when such tilting force is relieved; and the spring pillar assembly, the outer cover, and the tilt ring being capable of swivelling at the bearing assembly to rotate the seat about the longitudinal axis.

22. The chair of claim 21, wherein the tilt ring comprises a flexible ring, the tilt ring being capable of elastic displacement when tilting force is applied.

23. A chair comprising:

a seat;

a base having legs that extend to the floor;

a pillar assembly connected to the seat at a first end;

a tilt ring coupled to a second end of the pillar assembly and rotatably coupled to the base, wherein the tilt ring is adapted to tilt the pillar assembly and the seat relative to the base in response to a tilting force applied to from the seat, wherein the seat and the pillar assembly tilt in the same direction relative to the seat;

a keyhole delimiter defining a keyhole engaged by the second end of the pillar assembly to limit the degrees of tilt permitted; and a clocking system for swivelling the pillar assembly, the tilt ring, and the keyhole delimiter together, such that orientation of the keyhole is maintained in the course of rotating the seat.

24. The chair of claim 23, wherein the tilt pivot point is about the height of a user's ankle.

25. A chair comprising:

a seat;

a base having legs that extend to the floor;

a pillar assembly connected to the seat at a first end;

an outer cover housing a portion of the pillar assembly;

a tilt ring coupled to a second end of the pillar assembly and rotatably coupled to the base, wherein the tilt ring is adapted to tilt the pillar assembly, the outer cover and the seat away from an axial orientation relative to the base in response to a tilting force applied to from the seat and to return the pillar assembly, the outer cover and the seat to the axial orientation when the tilting force is relieved, and wherein the seat, the outer cover and the pillar assembly tilt in the same direction relative to the base.

* * * * *